US006561885B1

(12) United States Patent
Loth

(10) Patent No.: US 6,561,885 B1
(45) Date of Patent: May 13, 2003

(54) RING CUTTER FOR CUTTING CHIPS

(75) Inventor: Robert Loth, Lage-Müssen (DE)

(73) Assignee: B. Maier Zerkleinerungstechnik GmbH, Bielefeld (DE)

( * ) Notice: Subject to any disclaimer, the term of this patent is extended or adjusted under 35 U.S.C. 154(b) by 0 days.

(21) Appl. No.: 09/561,864

(22) Filed: Apr. 28, 2000

(30) Foreign Application Priority Data

May 7, 1999 (DE) ..... 199 21 597

(51) Int. Cl.[7] ..... B24B 7/00

(52) U.S. Cl. ..... 451/122; 451/69; 241/85; 241/86.2; 241/191; 241/278.2

(58) Field of Search ..... 451/45, 122, 128, 451/194, 178, 195, 232, 65, 69, 541; 241/85, 86.2, 88.1, 185.5, 191, 278.2, 280

(56) References Cited

U.S. PATENT DOCUMENTS 4,651,012 A 3/1987 Clark et al. ..... 250/505.1
5,209,025 A * 5/1993 Martin et al.
5,339,346 A 8/1994 White ..... 378/34
5,439,781 A 8/1995 MacDowell et al. ..... 430/311
5,525,094 A * 6/1996 Pallmann ..... 451/45
5,581,605 A 12/1996 Murakami et al. ..... 378/84
5,669,708 A 9/1997 Mashima et al. ..... 362/341
5,737,137 A 4/1998 Cohen et al. ..... 359/859
5,823,856 A * 10/1998 Pallmann ..... 451/45
5,868,602 A * 2/1999 Pallmann ..... 451/10

* cited by examiner

*Primary Examiner*—Eileen P. Morgan
(74) *Attorney, Agent, or Firm*—Ohlandt, Greeley, Ruggiero & Perle, L.L.P.

(57) ABSTRACT

A ring cutter that cuts chips with a ring of knives. Two carrier rings enclose a collar of knife packets. Each knife packet includes a knife clamped between a knife carrier a clamping plate with a cutting edge of the knife pointing to the inside of the ring. Fastening screws are threaded through a borehole in the clamping plate and an opening in the knife and are screwed into a threaded borehole in the knife carrier. One of the fastening screws is configured as an alignment pin.

2 Claims, 3 Drawing Sheets

RING CUTTER FOR CUTTING CHIPS

FIELD OF THE INVENTION

The invention concerns a ring cutter for cutting chips. Such a cutter has become known, for example, from DE 3,247,629 C1.

DESCRIPTION OF RELATED ART

Cutters of this type are constructed as follows: the cutter comprises a ring of cutting knives. The ring of cutting knives, in turn, is comprised of a collar of knife packets. The knife packets are borne by two carrier rings, which enclose the knife packets between them. The ring cutter also has a rotor, which bears a multiple number of rotor blades.

Each knife packet contains the following components: a wearing [abrasion] plate, which is found in the region of the circular path of the rotor blades, a knife carrier, a clamping plate, as well as a knife clamped between knife carrier and clamping plate. For clamping, at least two fastening screws are used, which are arranged at a mutual distance in the longitudinal direction of the knife packet. Corresponding to the fastening screws, the clamping plate of the individual knife packet has borehole, the knife has a slot, and the knife carrier has a threaded borehole. The fastening screw is guided through the borehole in the clamping plate and the slot in the knife and screwed into the threaded borehole of the knife carrier.

The knives have only a limited service life of several hours. After this, they are worn out and must be changed for new knives. This means that the knife packets must be demounted. The fastening screws are unscrewed, the worn knives are removed, new knives are inserted, the clamping plate is again applied, and the fastening screws are guided through the boreholes in the clamping plate and the slots in the knives and are screwed into the threaded boreholes of the knife carrier. This involves the precise positioning of the knives and the clamping plate. In particular, the front position of the knife must be accurately adjusted, i.e., the radial position of the cutting edge. This process is time-consuming and requires great care and attention.

The clamping plate was previously attached by means of a guide slot and a pin engaged therein.

The object of the invention is to create a ring cutter of the type described initially, such that the knife packet can be easily and rapidly mounted with a position-precise clamping plate and position-precise knife.

BRIEF SUMMARY OF THE INVENTION

Accordingly, the individual fastening screws—together with the borehole in the clamping plate, the slot in the knife and the borehole in the knife carrier—are utilized for centering. In this way, a very considerable simplification is achieved in mounting, as well as a high adjustment precision of the knife involved.

The invention is explained in more detail on the basis of the drawings. The following is represented, therein, taken individually:

DESCRIPTION OF THE INVENTION

Figure 1:
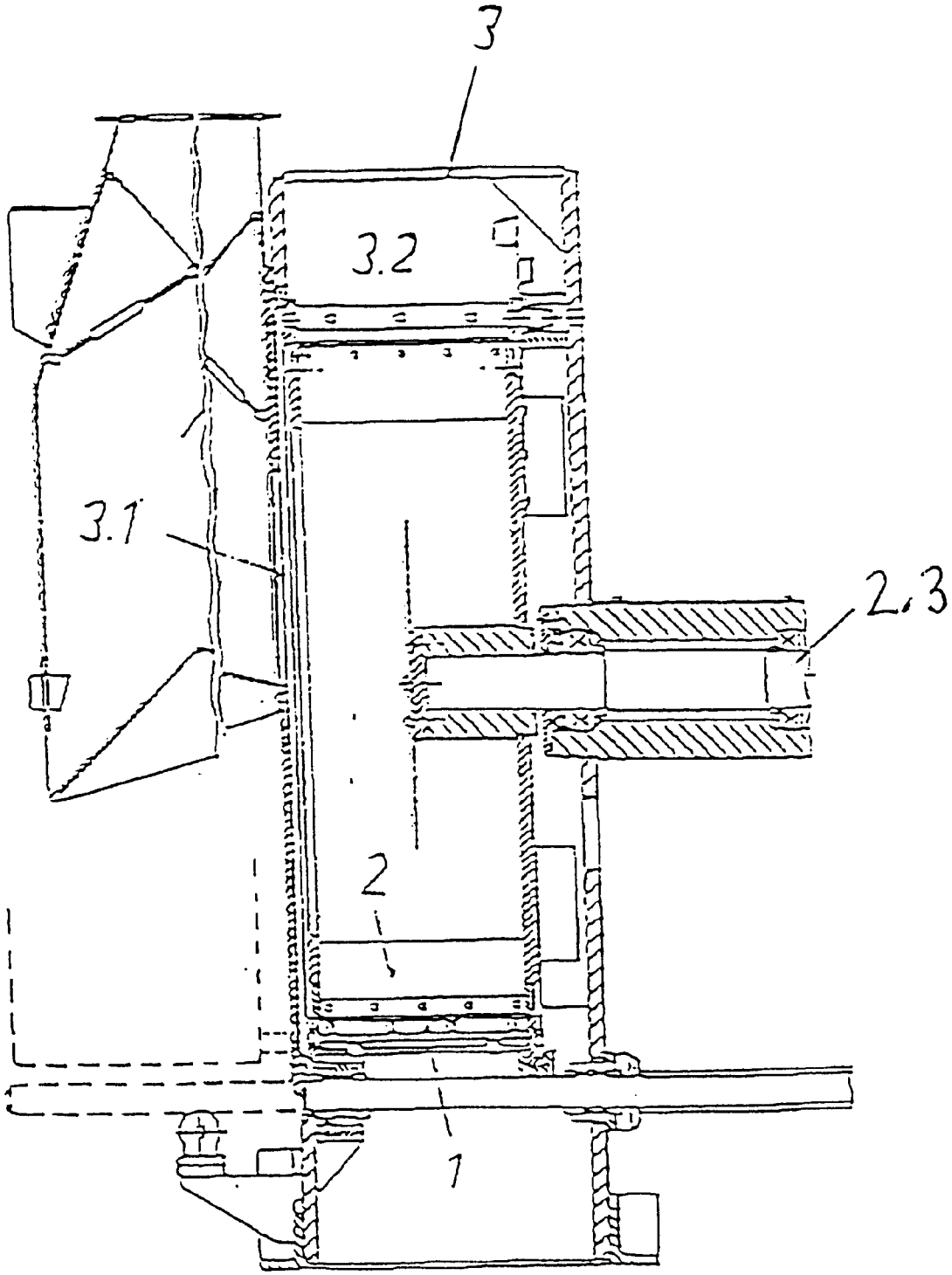
FIG. 1 shows a ring cutter in an axial section.

The ring cutter shown in FIG. 1 comprises a stationary ring of cutting knives 1. The ring of knives 1 surrounds a rotor 2, which sits on a rotor shaft 2.3. The ring of knives 1 and rotor 2 arranged co-axially to one another. Ring of knives 1 is incorporated rigidly in a housing 3. Housing 3 has an inlet 3.1 for introducing chips, as well as a chip discharge channel 3.2, which surrounds ring of knives 1.

Figure 2:
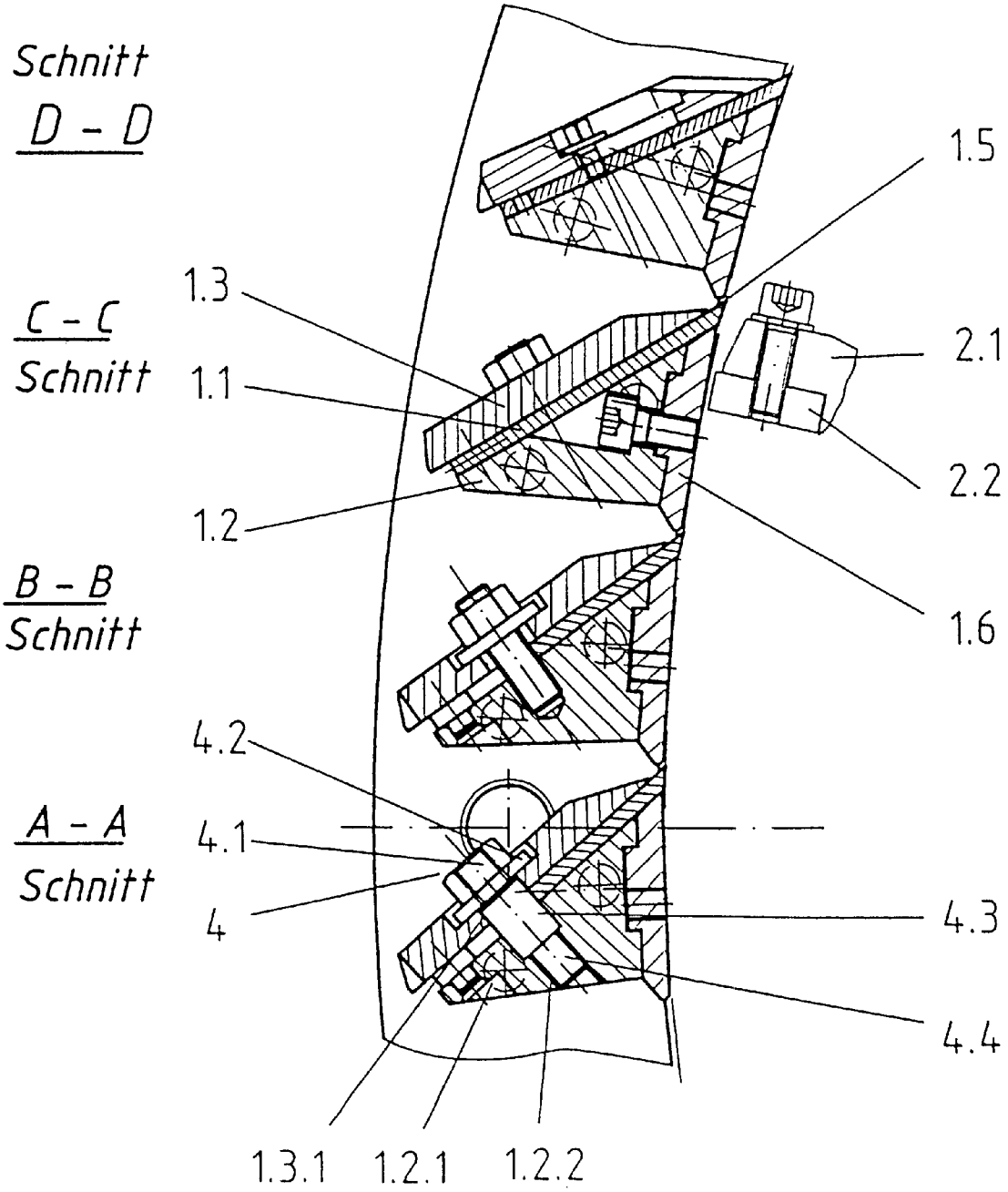
FIG. 2 shows an excerpt from the ring of knives contained in FIG. 1 in a view in the axial direction and enlarged relative to the subject of FIG. 1; therein, 4 sectional views placed through a knife packet, which is shown in FIG. 3, are seen.
Figure 3:
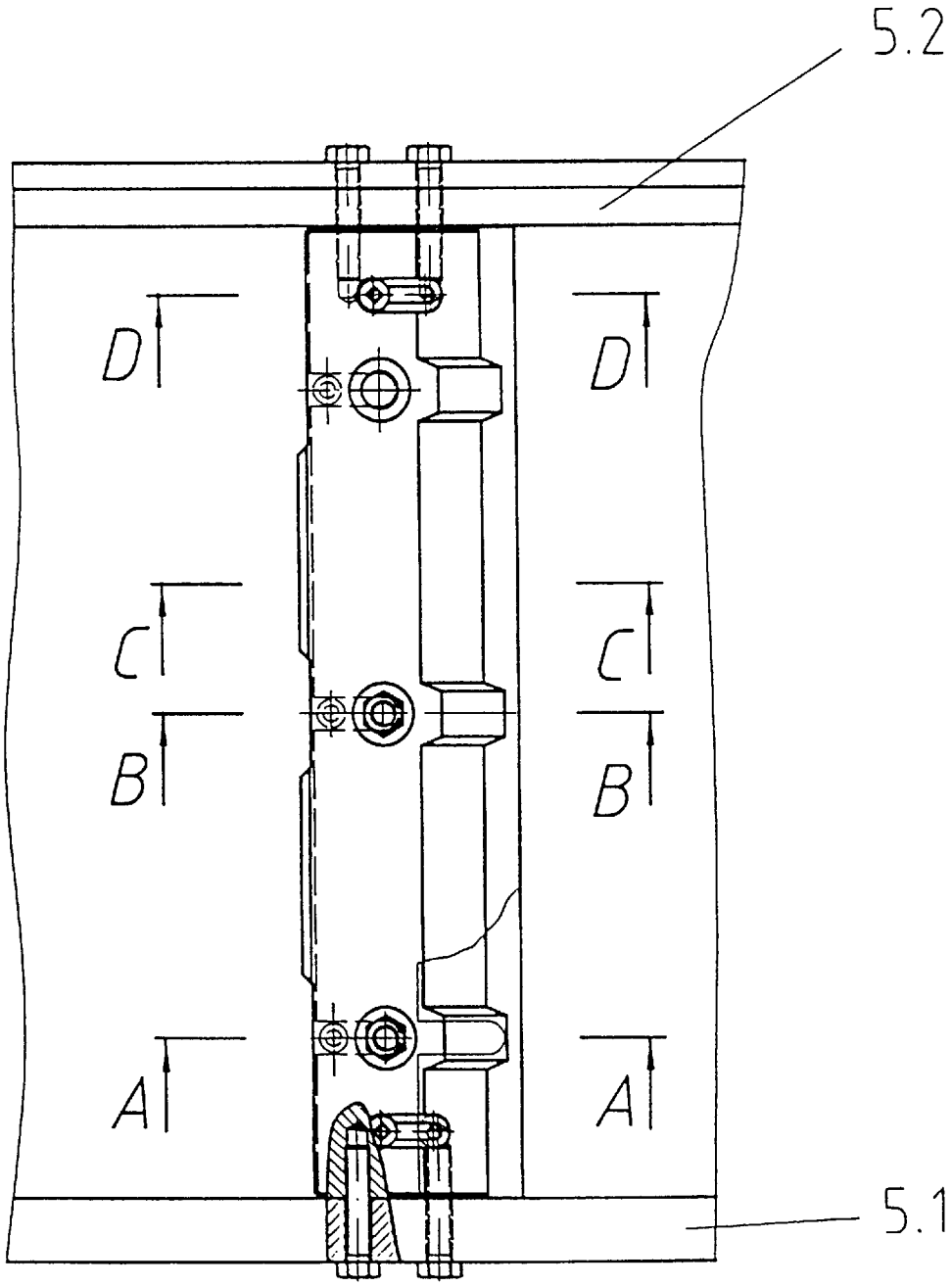
FIG. 3 shows a top view onto a knife packet mounted in the ring of knives, on a smaller scale than the view of FIG. 2.

The sections shown in FIG. 2 are placed at various points through the knife packet shown in FIG. 3, i.e., in the cutting planes A—A, B—B, C—C and D—D. The knife packet has a knife 1.1. This is clamped between a knife carrier 1.2 and a clamping plate 1.3. Additionally, a wearing [abrasion] plate 1.6 is provided, which is screwed with the knife carrier 1.2. The knife 1.1 of a knife carrier 1.2 forms a knife gap 1.5 with wearing plate 1.6 of an adjacent knife carrier 1.2.

A rotor blade 2.1 is shown by sketched-in lines. Rotor blade 2.1 bears a gap knife 2.2. It is recognized that both the radial position of gap knife 2.2 as well as the radial position of knife 1.1 each have a critical dimension. If these dimensions are not maintained, then a collision may occur between knife 1.1 and gap knife 2.2.

FIG. 2 shows further details of the knife packet. The individual components of the knife packet—except for wearing plate 1.6—are mounted by means of fastening screws 4 with one another, of which fastening screw 4 is shown. The fastening screw has a nut element 4.1 with a shoulder 4.2. An alignment pin 4.3 is connected to shoulder 4.2 and finally a threaded pin 4.4.

Clamping plate 1.3 has an alignment borehole 1.3.1, and knife carrier 1.2 has an alignment borehole 1.2.1 as well as a threaded borehole 1.2.2. The alignment pin 4.3 produces a precise centering of clamping plate 1.3, knife 1.1 and knife carrier 1.2.

It can be seen from FIG. 3 how the knife packet is mounted between two carrier rings 5.1 and 5.2.

What is claimed is:

1. A ring cutter for cutting chips, comprising:

an inlet for introducing chips;

a plurality of knife packets and two carrier rings between which said knife packets are mounted;

a rotor that bears a multiple number of rotor blades, which is surrounded by said plurality of knife packets;

wherein each of said knife packets includes:

a knife carrier, which is adapted to hold a knife and which has at least two boreholes, each of which has a first portion that is threaded and a second non-threaded portion, a clamping plate, which has at least two boreholes, a knife clamped between said knife carrier and said clamping plate, and at least two fastening screws, each of which is guided through a respective borehole in said clamping plate and through a respective opening in said knife and is screwed in a respective threaded portion of said respective borehole in said knife carrier;

wherein at least one of said fastening screws has a shaft with a first portion that is configured as an alignment pin and a second portion that is threaded; and wherein said boreholes of said clamping plate, said non-threaded portions, of said boreholes of said knife carrier and said first portion of said fastening screws are dimensioned in their diameters so that each of said first portions of said fastening screws mates with a respective borehole of said clamping plate and with a respective non-threaded portion of said knife carrier, to provide centering of said knife, said knife carrier and said clamping plate in relation to each other.

2. A ring cutter according to claim 1, wherein each of said knife packets further includes a wearing plate that is screwed with said knife carrier and forms a knife gap with a knife of an adjacent knife carrier.

* * * * *